US008293130B2

(12) United States Patent
Kaneko

(10) Patent No.: US 8,293,130 B2
(45) **Date of Patent: *Oct. 23, 2012**

(54) REFRIGERATOR OIL COMPOSITION

(75) Inventor: Masato Kaneko, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 328 days.

This patent is subject to a terminal disclaimer.

(21) Appl. No.: 11/575,256

(22) PCT Filed: Sep. 12, 2005

(86) PCT No.: PCT/JP2005/016781

§ 371 (c)(1),
(2), (4) Date: Mar. 14, 2007

(87) PCT Pub. No.: WO2006/030748

PCT Pub. Date: Mar. 23, 2006

(65) Prior Publication Data

US 2007/0290164 A1 Dec. 20, 2007

(30) Foreign Application Priority Data

Sep. 14, 2004 (WO) ..... PCT/JP2004/013366

(51) Int. Cl.
*C09K 5/00* (2006.01)
*C09K 5/04* (2006.01)

(52) U.S. Cl. ..... 252/67; 252/68

(58) Field of Classification Search ..... 252/68, 252/51, 67; 508/539, 579
See application file for complete search history.

(56) References Cited

U.S. PATENT DOCUMENTS

| | | | | |
|---|---|---|---|---|
| 5,376,186 | A | 12/1994 | Uchida et al. | |
| 5,379,186 | A * | 1/1995 | Gold et al. | 361/706 |
| 5,449,472 | A * | 9/1995 | Egawa et al. | 252/68 |
| 6,306,803 | B1 * | 10/2001 | Tazaki | 508/539 |
| 6,846,430 | B2 * | 1/2005 | Tazaki | 252/68 |

FOREIGN PATENT DOCUMENTS

| | | | |
|---|---|---|---|
| EP | 0 732 391 | A1 | 9/1996 |
| EP | 1 312 663 | A1 | 5/2003 |
| JP | 10 168475 | | 6/1998 |
| JP | 2001 11480 | | 1/2001 |
| JP | 2001 49282 | | 2/2001 |
| JP | 2001 181661 | | 7/2001 |
| WO | 01/48128 | * | 7/2001 |

* cited by examiner

*Primary Examiner* — Ling Choi
*Assistant Examiner* — Monique Peets
(74) *Attorney, Agent, or Firm* — Oblon, Spivak, McClelland, Maier & Neustadt, L.L.P.

(57) ABSTRACT

Disclosed is a refrigerator oil composition containing a base oil (A) composed of a polyvinyl ether, an organic sulfur compound (B) having a sulfur content of not more than 35% by mass and a refrigerant (C), in which a total sulfur content is 0.01 to 0.1% by mass with respect to a total amount of the components (A) and (B). Such the novel refrigerator oil composition does not cause environmental problems such as ozone layer destruction and global warming, and can retain the lubrication properties for a long period of time, while preventing a capillary in a refrigeration cycle from clogging.

17 Claims, 1 Drawing Sheet

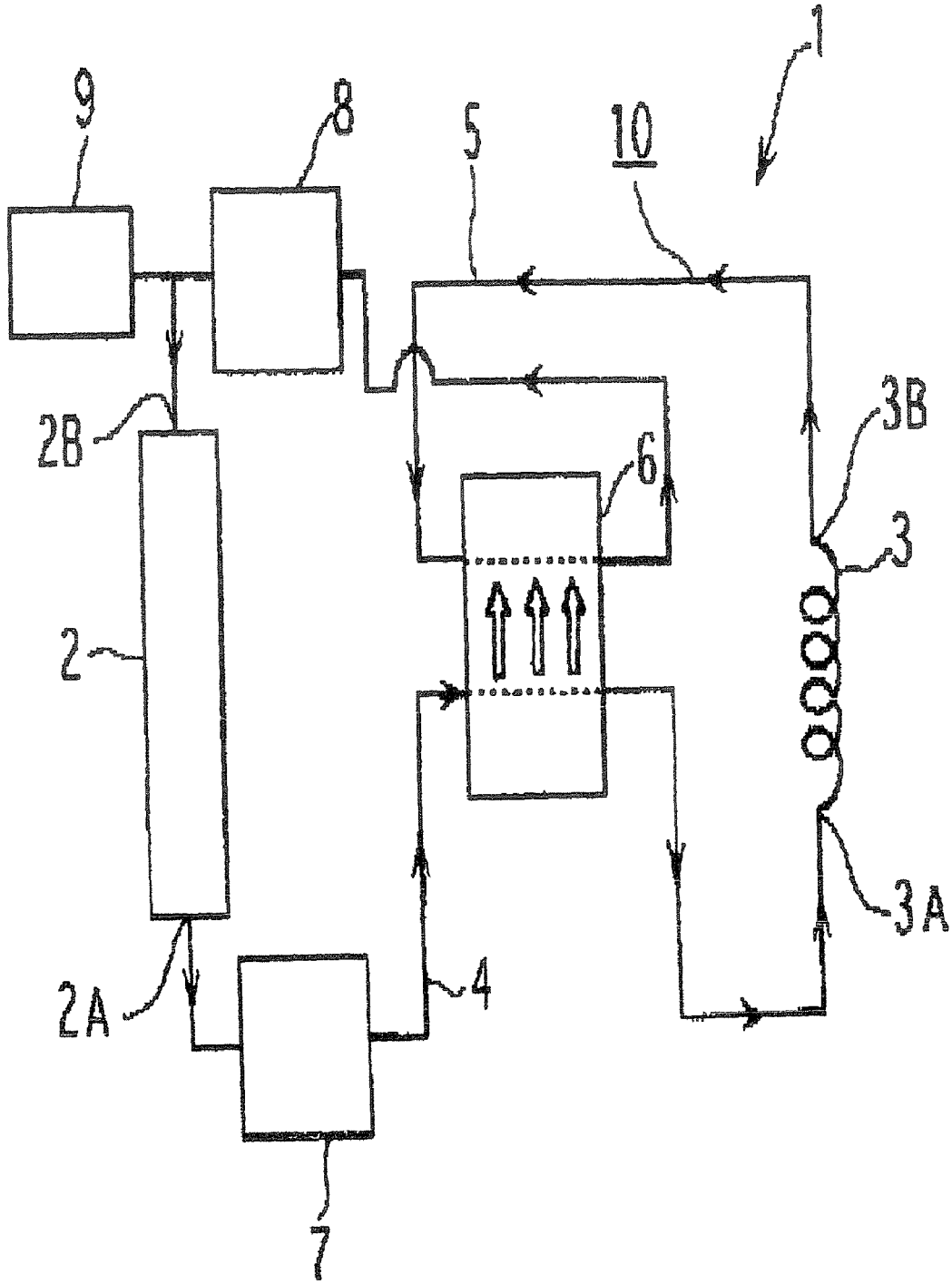
1
9
8
5
10
2B
6
3B
3
2
3A
2A
4
7

REFRIGERATOR OIL COMPOSITION

This application is a 371 of PCT/JP05/16781 filed Sep. 12, 2005.

TECHNICAL FIELD

The present invention relates to a novel refrigerator oil composition, particularly a novel refrigerator oil composition provided with excellent lubrication property for a long period of time without clogging a capillary in a refrigerating cycle.

BACKGROUND ART

In general, the compression-refrigerating cycle of a refrigerator, such as a compression-type refrigerator composed of a compressor, a condenser, an expansion valve, and an evaporator, is constructed to allow a mixture of a refrigerant and a lubricating oil to circulate in this closed system. In such a compression-type refrigerator, conventionally, chlorofluorocarbon such as dichlorodifluoromethane (R-12) or chlorodifluoromethane (R-22) has been used as a refrigerant. For using in combination with chlorofluorocarbon, various kinds of lubricating oils have been produced and employed. However, there is a concern that the chlorofluorocarbon compounds, which have been conventionally used as refrigerants, may cause environmental pollution problems, such as ozone layer destruction, when they are discharged into the atmosphere. For this reason, hydrofluorocarbon, fluorocarbon, or the like, as typified by 1,1,1,2-tetrafluoroethane (R-134a), has been used as a new refrigerant.

On the other hand, in a refrigerator oil composition, a phosphorous additive, typically tricresyl phosphate (TCP), has been used as an extreme-pressure agent. However, such a phosphorous extreme-pressure agent had a problem in that it could be denatured and become sludge by thermal decomposition or hydrolysis, or by a tribochemical reaction or the like on a frictional surface. In addition, by denaturing and sludging, the phosphorous additive would be exhausted so that it could not retain its lubrication property for a long period of time, thereby resulting in seizure or wear.

There has been proposed a sulfur-containing lubricating oil obtained by using as a base oil a mixture of a synthetic oil such as poly-α-olefin and a mineral oil and adding thereto an organic sulfur compound (Patent Document 1). The sulfur-containing lubricating oil proposed is excellent in thermal resistance and wear resistance with small variations in viscosity against thermal changes, as well as excellent in fluorocarbon solubility. According to Patent Document 1, in such the lubricating oil composition for a refrigerator, the content of an organic sulfur compound is important. For example, when mineral oil is used as a base oil, the organic sulfur compound used may be naturally found in mineral oil. However, lubricating oil compositions for a refrigerator using, as a base oil, polyvinyl ether having various excellent properties have not been provided with sufficient wear resistance and extreme-pressure property only by controlling their sulfur contents.

Patent Document 1: Japanese Patent Application Laid-Open No. 58-103594

DISCLOSURE OF THE INVENTION

The present invention has been made to solve such the problems and intends to provide a lubricating oil composition for a refrigerator which is capable of retaining its lubrication property for a long period of time without clogging a capillary in a refrigeration cycle.

As a result of intensive studies for developing a lubricating oil composition for a refrigerator having the above-mentioned properties, the inventors of the present invention have found that a refrigerator oil containing polyvinyl ether (PVE) as a base oil and a specific organic sulfur compound can retain its lubrication property for a long period of time and prevent a capillary in a refrigeration cycle from clogging when a natural refrigerant such as hydrofluorocarbon, fluorocarbon, carbon dioxide gas, ammonia, or a hydrocarbon is used. The present invention has been completed on a basis of such the finding.

That is, according to the present invention, there is provided a refrigerator oil composition including: a base oil (A) composed of a polyvinyl ether; an organic sulfur compound (B) having a sulfur content of not more than 35% by mass; and a refrigerant (C), in which a total sulfur content is 0.01 to 0.1% by mass with respect to a total amount of the components (A) and (B).

BRIEF DESCRIPTION OF THE DRAWING

FIG. 1 is a diagram illustrating a capillary-clogging testing device.

DESCRIPTION OF REFERENCE NUMERALS

1 CAPILLARY-CLOGGING TESTING DEVICE
2 COMPRESSOR
2A COMPRESSOR INLET ORIFICE
2B COMPRESSOR OUTLET ORIFICE
3 CAPILLARY TUBE
3A CAPILLARY INLET ORIFICE
3B CAPILLARY OUTLET ORIFICE
4 HIGH-TEMPERATURE SIDE CHANNEL
5 LOW-TEMPERATURE SIDE CHANNEL
6 HEAT EXCHANGER
7 DISCHARGE-SIDE PRESSURE GAUGE
8 SUCTION-SIDE PRESSURE GAUGE
9 VALVE FOR CONNECTING VACUUM PUMP
10 SIMULATED CIRCULATION SYSTEM

BEST MODE FOR CARRYING OUT THE INVENTION

A lubricating oil composition of the present invention uses polyvinyl ether as a base oil (A). Examples of a polyvinyl compound include those each having a structural unit represented by the general formula (I):

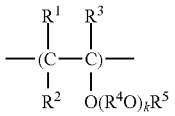

(I)

wherein, $R^1$, $R^2$, and $R^3$ each represent a hydrogen atom or a hydrocarbon group having 1 to 8 carbon atoms, which may be identical with or different from each other; $R^4$ represents a divalent hydrocarbon group having 1 to 10 carbon atoms; $R^5$ represents a hydrocarbon group having 1 to 20 carbon atoms; k represents an average number of 0 to 10; $R^1$ to $R^5$ may be identical with or different from each other in every structural unit; and when there are two or more $R^4O$, they may be identical with or different from each other. In addition, a polyvinyl ether compound composed of a block or random copolymer having a structural unit represented by the above-mentioned general formula (I) and a structural unit represented by the general formula (II) may also be used:

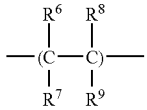

(II)

wherein, $R^6$ to $R^9$ each represent a hydrogen atom or a hydrocarbon group having 1 to 20 carbon atoms, which may be identical with or different from each other; and $R^6$ to $R^9$ may be identical with or different from each other in every structural unit. In the above-mentioned general formula (I), $R^1$, $R^2$, and $R^3$ each represent a hydrogen atom or a hydrocarbon group having 1 to 8 carbon atoms, preferably 1 to 4 carbon atoms, which may be identical with or different from each other. Here, specific examples of the "hydrocarbon group" include: alkyl groups such as a methyl group, an ethyl group, an n-propyl group, an isopropyl group, an n-butyl group, an isobutyl group, a sec-butyl group, a tert-butyl group, various pentyl groups, various hexyl groups, various heptyl groups, and various octyl groups; cycloalkyl groups such as a cyclopentyl group, a cyclohexyl group, various methylcyclohexyl groups, various ethylcyclohexyl groups, and various dimethylcyclohexyl groups; aryl groups such as a phenyl group, various methylphenyl groups, various ethylphenyl groups, and various dimethylphenyl groups; and arylalkyl groups such as a benzyl group, various phenylethyl groups, and various methylbenzyl groups. Note that in each of $R^1$, $R^2$, and $R^3$, a hydrogen atom is preferable.

On the other hand, $R^4$ in the general formula (I) represents a divalent hydrocarbon group having 1 to 10 carbon atoms, preferably 2 to 10 carbon atoms. Here, specific examples of the "divalent hydrocarbon group having 1 to 10 carbon atoms" include: divalent aliphatic groups including a methylene group, an ethylene group, a phenylethylene group, a 1,2-propylene group, a 2-phenyl-1,2-propylene group, a 1,3-propylene group, various butylene groups, various pentylene groups, various hexylene groups, various heptylene groups, various octylene groups, various nonylene groups, and various decylene groups; alicyclic groups each having two binding sites on an alicyclic hydrocarbon, such as cyclohexane, methyl cyclohexane, ethyl cyclohexane, dimethyl cyclohexane, and propyl cyclohexane; divalent aromatic hydrocarbon groups such as various phenylene groups, various methyl phenylene groups, various ethyl phenylene groups, various dimethyl phenylene groups, and various naphthylene groups; alkyl aromatic groups each having monovalent binding sites on both an alkyl group moiety and an aromatic group moiety of an alkyl aromatic hydrocarbon, such as toluene, xylene, and ethyl benzene; and alkyl aromatic groups each having a binding site on an alkyl group moiety of an polyalkyl aromatic hydrocarbon, such as xylene and diethyl benzene. Among them, the aliphatic group having 2 to 4 carbon atoms is particularly preferable.

Note that k in the general formula (I) represents the number of repetition of $R^4O$, and the average value thereof is in a range of 0 to 10, or preferably 0 to 5. When there are two or more $R^4$, they may be identical with or different from each other. In addition, $R^5$ in the general formula (I) represents a hydrocarbon group having 1 to 20 carbon atoms or preferably 1 to 10 carbon atoms. Specific examples of the hydrocarbon group include: alkyl groups such as a methyl group, an ethyl group, an n-propyl group, an isopropyl group, an n-butyl group, an isobutyl group, a sec-butyl group, a tert-butyl group, various pentyl groups, various hexyl groups, various heptyl groups, various octyl groups, various nonyl groups, and various decyl groups; cycloalkyl groups such as a cyclopentyl group, a cyclohexyl group, various methylcyclohexyl groups, various ethylcyclohexyl groups, various propylcyclohexyl groups, and various dimethylcyclohexyl groups; aryl groups such as a phenyl group, various methylphenyl groups, various ethylphenyl groups, various dimethylphenyl groups, various propylphenyl groups, various trimethylphenyl groups, various butylphenyl groups, and various naphthyl groups; and arylalkyl groups such as a benzyl group, various phenylethyl groups, various methylbenzyl groups, various phenylpropyl groups, and various phenylbutyl groups.

Note that any of $R^1$ to $R^5$ may be identical with or different from each other in every structural unit. A polyvinyl ether compound represented by the general formula (I) preferably has the carbon/oxygen molar ratio in a range of 4.2 to 7.0. The molar ratio of 4.2 or more may provide a low hydroscopic property, and the molar ratio of 7.0 or less may provide sufficient compatibility with a refrigerant.

In the above-mentioned general formula (II), $R^6$ to $R^9$ each represents a hydrogen atom or a hydrocarbon group having 1 to 20 carbon atoms, which may be identical with or different from each other. Here, examples of the hydrocarbon group having 1 to 20 carbon atoms can include those exemplified in the description of $R^5$ of the above-mentioned general formula (I). Note that $R^6$ to $R^9$ may be identical with or different from each other in every structural unit.

The polyvinyl ether compound composed of a block or random copolymer having both the structural unit represented by the general formula (I) and the structural unit represented by the general formula (II) preferably has a carbon/oxygen molar ratio of 4.2 to 7.0. The compound can be provided with a low hydroscopic property when the molar ratio is 4.2 or more, and also provided with a sufficient compatibility with a refrigerant when the molar ratio is 7.0 or less.

The base oil (A) used in the present invention is preferably any of those described above. Each of the base oils may be independently used or two or more of then may be used in combination. In addition, the base oil (A) used in the present invention has a kinematic viscosity of preferably 3 to 1,000 $mm^2/s$ at 40° C. If it is 3 $mm^2/s$ or more, the base oil can be provided with sufficient lubrication property. If it is 1,000 $mm^2/S$ or less, the base oil can be provided with high energy efficiency without being provided with an excessive load. From the viewpoints as described above, the kinematic viscosity of the base oil is preferably in the range of 5 to 500 $mm^2/s$, more preferably in the range of 5 to 150 $mm^2/s$.

Next, the present invention is characterized by containing an organic sulfur compound having a sulfur content of not more than 35% by mass as a component (B) If the content of sulfur exceeds 35% by mass, deterioration and sludging may occur. To be specific, polysulfide which contains three or more sulfur atoms in a molecule may lead to such the case. In addition, it is preferable that the content of sulfur exceeds 5% by mass because of attaining a decrease in an addition amount of the component (B).

Examples of the organic sulfur compound (B) preferably used in the present invention include aliphatic sulfur compounds, heterocyclic sulfur compounds, and aromatic sulfur compounds.

The aliphatic sulfur compound preferably has 12 or more carbon atoms, more preferably 14 or more carbon atoms, or particularly preferably 18 or more carbon atoms. Specific examples of the aliphatic sulfur compound include dioctyl sulfide, didodecyl sulfide, and ditetradecyl sulfide.

The heterocyclic sulfur compound preferably has 8 or more carbon atoms, more preferably 10 or more carbon atoms, or particularly preferably 12 or more carbon atoms. Specific examples of the heterocyclic sulfur compound include benzothiophene, dibenzothiophene, phenothiazine, benzothiapyran, thiapyran, thianthrene, dibenzothiapyran, diphenylene disulfide, and alkyl derivatives thereof.

The aromatic sulfur compound preferably has 12 or more carbon atoms or more preferably 16 or more carbon atoms. Specific examples of the aromatic sulfur compound include 4,4'-thiobis(3-methyl-6-t-butylphenol), diphenyl sulfide, dioctyldiphenyl sulfide, and dialkyldiphenylene sulfide.

Furthermore, an aliphatic sulfur compound having at least 8 carbon atoms, a heterocyclic sulfur compound, and an organic sulfur compound other than aromatic sulfur compound may be used. For examples, such the compounds include organic sulfur compounds having 8 or more, preferably 10 or more carbon atoms and one or more sulfur (S) atoms in a molecule. Specific examples thereof include sulfolane, diphenyl sulfoxide, diphenyl sulfone, thiazole, thiazole derivatives, thiaadamantane, 2-thienyl carbinol, and thiopheneacetic acid.

Among the above-mentioned organic sulfur compounds, diphenylene disulfide, phenothiazine, and dialkyl diphenylene sulfide are preferably used.

The refrigerator oil composition of the present invention has an essential sulfur content of 0.01 to 0.1% by mass on the basis of the total amount of components (A) and (B). If the sulfur content is 0.01% by mass or more, a sufficient lubrication property can be attained. If it is 0.1% by mass or less, the generation of sludge due to denaturation or the like can be sufficiently prevented. From the viewpoints as described above, the sulfur content is preferably in the range of 0.02 to 0.05% by mass, preferably in the range of 0.025 to 0.035% by mass.

Furthermore, any of additives conventionally used in refrigerator oil compositions can be added to the lubricating oil composition of the present invention. In particular, the additives preferably include antioxidants, acid scavengers, and defoaming agents.

Examples of the antioxidants which can be used include, but not particularly limited to, phenol-based antioxidants and amine-based antioxidants. The acid scavenger is formulated in a refrigerator oil composition to prevent hydrolysis, and examples thereof include phenyl glycidyl ethers, alkyl glycidyl ethers, alkylene glycol glycidyl ethers, cyclohexene oxides, α-olefin oxides, and epoxy compounds such as epoxidized soybean oil. Among them, phenyl glycidyl ethers, alkyl glycidyl ethers, alkylene glycol glycidyl ethers, cyclohexene oxides, and α-olefin oxides are preferable in terms of compatibility. Examples of the defoaming agents include silicone oil and fluorinated silicone oil.

In addition, any of other additives including copper-inactivators, such as benzotriazol or derivatives thereof, may be added as far as it does not affect the purpose of the present invention. Those additives may be added generally in the amount of 0.005 to 5% by weight, respectively.

In addition, a refrigerant typically used in the lubricating oil composition of the present invention is at least one selected from hydrofluorocarbons, fluorocarbons, carbon dioxide gas, hydrocarbons, and ammonia. Here, the term "hydrocarbon" refers to one typically used as a refrigerant, and examples thereof include propane, butane, and a mixture thereof. In the lubricating oil composition of the present invention, at least one selected from carbon dioxide gas, hydrocarbons, and ammonia is particularly preferably used as the refrigerant.

The refrigerator oil composition may contain any of those refrigerants in a content of 10 to 99% by mass in general. If it is 10% by mass or more, it exerts its sufficient refrigeration ability. If it is 99% by mass or less, the lubricating oil is in a sufficient amount, so there is no problem of seizure or wear. Therefore, from the viewpoints described above, the range of 30 to 95% by mass is more preferable.

The refrigerator oil composition of the present invention can be used in various applications, such as air conditioners, refrigerators, gas-heat pumps (GHPs), automatic vending machines, showcase refrigerators, car air conditioners, water heaters, and floor heating appliances.

EXAMPLES

Hereinafter, the present invention will be described in further detail with reference to examples. However, the present invention is not limited to these examples at all.

(Evaluation Method)

1. Sealed Tube Test (Thermal Stability)

A refrigerator oil composition prepared by each of methods described in examples and comparative examples was placed in a glass tube of 10 ml in internal volume, followed by the addition of copper, aluminum, and iron metal catalysts. The glass tube was closed and then left standing at 175° C. for 30 days, followed by evaluating the appearance of the refrigerator oil composition, the appearance of copper, and the presence or absence of sludge.

2. Closed Falex Test (Lubrication Property)

A closed Falex friction testing machine was used to determine wear loss (mg) in accordance with ASTM D2670. Here, the test was conducted under the following conditions: a load of 1,335 N, a rotational frequency of 300 rpm, a temperature of 80° C., and a test period of 1 hour, and a pin used was AISIC1137 and a block used was SAE3135.

3. Capillary Clogging Test

Using a testing device shown in FIG. 1, a decreasing rate of a capillary flow volume after 1,000 hours was evaluated. The testing device 1, which is one disclosed in Japanese Patent Application Laid-Open No. 11-183334, includes: a compressor 2; a capillary tube 3 provided as means for reducing temperature and pressure; a high-temperature side channel 4 that allows a discharge orifice 2A of the compressor 2 to communicate with an inlet orifice 3A of the capillary tube 3; a low-temperature side channel 5 that allows an outlet orifice 3B of the capillary tube 3 to communicate with a suction inlet 2B of the compressor 2; and a heat exchanger 6 placed on the high-temperature side channel 4 and the low-temperature side channel 5 to carry out a heat exchange between refrigerants in the respective flow channels 4 and 5. On the high-temperature side channel 4, furthermore, a discharge-side pressure gauge 7 is provided between the compressor 2 and the heat exchanger 6. On the low-temperature side channel 5, a suction-side pressure gauge 8 is provided between the heat exchanger 6 and the compressor 2. On the downstream of the suction-side pressure gauge 8, a valve 9 for connecting with a vacuum pump is provided. Consequently, those structural components constitute a simulated circulation system 10 that allows the circulation of a refrigerant containing a refrigerator oil.

The test was conducted under the following conditions: a suction-side pressure (Ps) of 0.4 MPa; a discharge-side pressure (Pd) of 3.3 MPa; an inlet temperature of the heat exchanger (Td) of 110° C.; and an outlet temperature of the heat exchanger (Ts) of 30° C. In addition, a refrigerant used was isobutane (R600a), and each amount of a sample oil (total amount of the components (A) and (B)) and the refrigerant in mixture was 400 g.

Examples 1 to 8 and Comparative Examples 1 to 6

The respective kinds of refrigerator oils composed of a base oil (A) and a specific compound (B) as shown in Table 1 were prepared and then evaluated by the evaluation method described above. The results are shown in Table 1.

Here, symbols that represent the respective components of (A) and (B) are as shown below.

A-1; polyethyl vinyl ether polyisobutyl vinyl ether copolymer (molar ratio of polyethyl vinyl ether:polyisobutyl vinyl ether=1:9, viscosity of 68 $mm^2/s$ at 40° C.)

A-2; polyethyl vinyl ether polymethyl vinyl ether copolymer (molar ratio of polyethyl vinyl ether:polymethyl vinyl ether=1:1, viscosity of 100 $mm^2/s$ at 40° C.)

A-3; polyisobutyl vinyl ether (viscosity of 10 $mm^2/s$ at 40° C.)

A-4; polyethyl vinyl ether (viscosity of 430 $mm^2/s$ at 40° C.)

B-1; benzothiophene (sulfur content; 23.9% by mass)

B-2; dibenzothiophene (sulfur content; 17.4% by mass)

B-3; diphenylene disulfide (sulfur content; 29.6% by mass)

B-4; phenothiazine (sulfur content; 16.1% by mass)

B-5; diphenyl sulfide (sulfur content; 17.2% by mass)

B-6; dioctyldiphenyl sulfide (sulfur content; 7.8% by mass)

B-7; dioctyl polysulfide (sulfur content; 39% by mass)

B-8; tricresyl phosphate

B-9; diphenyl sulfone (sulfur content; 14% by mass)

TABLE 1

| | | Examples | | | |
|---|---|---|---|---|---|
| | | 1 | 2 | 3 | 4 |
| Components (A) | A-1 | 99.88 | — | — | — |
| | A-2 | — | 99.83 | — | — |
| | A-3 | — | — | 99.9 | — |
| | A-4 | — | — | — | 99.82 |
| Components (B) | B-1 | 0.12 | — | — | — |
| | B-2 | — | 0.17 | — | — |
| | B-3 | — | — | 0.1 | — |
| | B-4 | — | — | — | 0.18 |
| | B-5 | — | — | — | — |
| | B-6 | — | — | — | — |
| | B-7 | — | — | — | — |
| | B-8 | — | — | — | — |
| | B-9 | — | — | — | — |
| Content of sulfur (% by mass) | | 0.03 | 0.03 | 0.03 | 0.03 |
| Sealed tube test | Oil appearance | Good | Good | Good | Good |
| | Copper appearance | Good | Good | Good | Good |
| | Presence or absence of sludge | Absence | Absence | Absence | Absence |
| Falex test (Wear loss: mg) | | 8 | 7 | 3 | 5 |
| Capillary clogging test (decreasing rate of flow volume; %) | | 1 | 1 | 1 | 1 |

| | | Examples | | | |
|---|---|---|---|---|---|
| | | 5 | 6 | 7 | 8 |
| Components (A) | A-1 | 99.83 | 99.6 | — | 99.8 |
| | A-2 | — | — | — | — |
| | A-3 | — | — | 99.7 | — |
| | A-4 | — | — | — | — |
| Components (B) | B-1 | — | — | — | — |
| | B-2 | — | — | — | — |
| | B-3 | — | — | 0.3 | — |
| | B-4 | — | — | — | — |
| | B-5 | 0.17 | — | — | — |
| | B-6 | — | 0.4 | — | — |
| | B-7 | — | — | — | — |
| | B-8 | — | — | — | — |
| | B-9 | — | — | — | 0.2 |
| Content of sulfur (% by mass) | | 0.03 | 0.03 | 0.03 | 0.03 |
| Sealed tube test | Oil appearance | Good | Good | Good | Good |
| | Copper appearance | Good | Good | Good | Good |
| | Presence or absence of sludge | Absence | Absence | Absence | Absence |
| Falex test (Wear loss: mg) | | 8 | 4 | 12 | 7 |
| Capillary clogging test (decreasing rate of flow volume; %) | | 1 | 1 | 1 | 1 |

| | | Comparative Examples | | | |
|---|---|---|---|---|---|
| | | 1 | 2 | 3 | 4 |
| Components (A) | A-1 | 99.98 | 99.4 | 99.98 | 99.5 |

TABLE 1-continued

| | | | | | |
|---|---|---|---|---|---|
| | A-2 | — | — | — | — |
| | A-3 | — | — | — | — |
| | A-4 | — | — | — | — |
| Components (B) | B-1 | 0.02 | 0.6 | — | — |
| | B-2 | — | — | — | — |
| | B-3 | — | — | 0.02 | 1 |
| | B-4 | — | — | — | — |
| | B-5 | — | — | — | — |
| | B-6 | — | — | — | — |
| | B-7 | — | — | — | — |
| | B-8 | — | — | — | — |
| | B-9 | — | — | — | — |
| Content of sulfur (% by mass) | | 0.005 | 0.14 | 0.006 | 0.3 |
| Sealed tube test | Oil appearance | Good | Pale yellow | Good | Pale yellow |
| | Copper appearance | Good | Discolored | Good | Discolored |
| | Presence or absence of sludge | Absence | Absence | Absence | Absence |
| Falex test (Wear loss: mg) | | Galling | 27 | Galling | 31 |
| Capillary clogging test (decreasing rate of flow volume; %) | | — | 5 | — | 6 |

| | | Comparative Examples | |
|---|---|---|---|
| | | 5 | 6 |
| Components (A) | A-1 | 99.9 | 99 |
| | A-2 | — | — |
| | A-3 | — | — |
| | A-4 | — | — |
| Components (B) | B-1 | — | — |
| | B-2 | — | — |
| | B-3 | — | — |
| | B-4 | — | — |
| | B-5 | — | — |
| | B-6 | — | — |
| | B-7 | 0.1 | |
| | B-8 | — | 1 |
| | B-9 | — | — |
| Content of sulfur (% by mass) | | 0.03 | — |
| Sealed tube test | Oil appearance | Yellow | Good |
| | Copper appearance | Black | Good |
| | Presence or absence of sludge | Presence | Absence |
| Falex test (Wear loss: mg) | | 34 | 16 |
| Capillary clogging test (decreasing rate of flow volume; %) | | — | 7 |

INDUSTRIAL APPLICABILITY

The novel refrigerator oil composition of the present invention does not cause any environmental problems such as ozone layer destruction and retains its lubrication property for a long period of time, while preventing a capillary in a refrigeration cycle from clogging. Therefore, it can be suitably used in any of air conditioners, refrigerators, gas-heat pumps (GHPs), automatic vending machines, showcase refrigerators, car air conditioners, water heaters, floor heating appliances, and so on.

The invention claimed is:

1. A refrigerator oil composition, comprising:
a base oil (A) comprising a polyvinyl ether:
one or more organic sulfur compounds (B); and
a refrigerant (C),
wherein a total sulfur content is 0.01 to 0.1% by mass with respect to a total amount of components (A) and (B), wherein the one or more organic sulfur compounds have a sulfur content of not more than 35% by mass, and wherein the one or more organic sulfur compounds (B) comprise a heterocyclic sulfur compound having at least 8 carbon atoms.

2. The refrigerator oil composition according to claim 1, wherein the base oil (A) has a viscosity of 3 to 1,000 $mm^2/s$ at 40° C.

3. The refrigerator oil composition according to claim 1, wherein the one or more organic sulfur compounds (B) comprise a heterocyclic sulfur compound having at least 10 carbon atoms.

4. The refrigerator oil composition according to claim 1, wherein the one or more organic sulfur compounds (B) comprise a heterocyclic sulfur compound having at least 12 carbon atoms.

5. The refrigerator oil composition according to claim 1, further comprising:
an antioxidant;
an acid scavenger; and
a defoaming agent.

6. The refrigerator oil composition according to claim 1, comprising no phosphorous extreme pressure agent.

7. The refrigerator oil composition according to claim 1, wherein the refrigerant is at least one selected from carbon dioxide gas, a hydrocarbon, and ammonia.

8. A refrigerator oil composition, comprising:
a base oil (A) comprising a polyvinyl ether:
one or more organic sulfur compounds (B); and
a refrigerant (C), wherein a total sulfur content is 0.01 to 0.1% by mass with respect to a total amount of components (A) and (B), wherein the one or more organic sulfur compounds have a sulfur content of not more than 35% by mass, and wherein the one or more organic sulfur compounds (B) are selected from the group consisting of phenothiazine, benzothiapyran, thiapyran, thianthrene, dibenzothiapyran, diphenylene disulfide, 4,4'-thiobis(3-methyl-6-t-butylphenol), dialkyldiphenylene sulfide, sulfolane, diphenyl sulfoxide, thiazole, thiaadamantane, 2-thienyl carbinol, and thiopheneacetic acid.

9. The refrigerator oil composition according to claim 1, wherein the base oil (A) has a viscosity of 5 to 500 $mm^2/s$ at 40° C.

10. The refrigerator oil composition according to claim 1, wherein the base oil (A) has a viscosity of 5 to 150 $mm^2/s$ at 40° C.

11. The refrigerator oil composition according to claim 1, wherein organic sulfur compound (B) has a sulfur content that exceeds 5% by mass.

12. The refrigerator oil composition according to claim 1, wherein a total sulfur content is 0.02 to 0.05% by mass with respect to a total amount of the components (A) and (B).

13. The refrigerator oil composition according to claim 1, wherein a total sulfur content is 0.025 to 0.035% by mass with respect to a total amount of the components (A) and (B).

14. The refrigerator oil composition according to claim 1, wherein base oil (A) consists essentially of a polyvinyl ether.

15. The refrigerator oil composition according to claim 14, wherein the base oil (A) has a viscosity of 5 to 500 $mm^2/s$ at 40° C., the one or more organic sulfur compounds (B) have a sulfur content that exceeds 5% by mass, and wherein the total sulfur content is 0.02 to 0.05% by mass with respect to a total amount of the components (A) and (B).

16. The refrigerator oil composition according to claim 8, wherein the base oil (A) has a viscosity of 5 to 500 $mm^2/s$ at 40° C., the one or more organic sulfur compounds (B) have a sulfur content that exceeds 5% by mass, and wherein the total sulfur content is 0.02 to 0.05% by mass with respect to a total amount of the components (A) and (B).

17. The refrigerator oil composition according to claim 1, wherein the base oil (A) consists of a polyvinyl ether having a viscosity of 5 to 500 $mm^2/s$ at 40° C., the one or more organic sulfur compounds (B) have a sulfur content that exceeds 5% by mass, and wherein the total sulfur content is 0.02 to 0.05% by mass with respect to a total amount of the components (A) and (B).

* * * * *